US005833169A

United States Patent [19]

Morand

[11] Patent Number: 5,833,169

[45] Date of Patent: Nov. 10, 1998

[54] LARGE ROLL BATHROOM TISSUE DISPENSER WITH STUB ROLL HOLDER

[75] Inventor: Michel Morand, Montreal, Canada

[73] Assignee: G. H. Wood & Wyant Inc., Lachine, Canada

[21] Appl. No.: 618,272

[22] Filed: Mar. 18, 1996

Related U.S. Application Data

[63] Continuation of Ser. No. 148,855, Nov. 8, 1993, abandoned.

[30] Foreign Application Priority Data

Sep. 2, 1993 [GB] United Kingdom ..... 9318218

[51] Int. Cl.[6] ..... B65H 19/00; B65H 16/06; B65H 18/04; B23Q 1/00

[52] U.S. Cl. ..... 242/560; 242/577; 242/596.4; 242/596.8; 242/597.6; 242/597.8; 225/34; 225/47; 269/48.1

[58] Field of Search ..... 242/560, 571, 242/577, 596.7, 596.8, 596–598, 597.5, 597.6, 597.8, 598.6, 599.4, 590, 591, 596.4, 594; 279/2.01, 2.21; 312/34.22; 223/106; 225/34, 37, 47; 83/650; 269/47, 48.1

[56] References Cited

U.S. PATENT DOCUMENTS

| | | | |
|---|---|---|---|
| 949,553 | 2/1910 | Smith | 242/55.3 |
| 1,234,746 | 7/1917 | Fish | 242/68 |
| 1,415,722 | 5/1922 | Silverman | 225/47 |
| 2,416,115 | 2/1947 | Neuman | 225/47 |
| 2,541,222 | 2/1951 | Egart et al. | 206/40.6 |
| 2,564,539 | 8/1951 | Lucan | 242/560 |
| 2,565,994 | 8/1951 | Sevenich | 242/55.53 |
| 2,576,254 | 11/1951 | Fletcher | 242/130 |
| 2,801,131 | 7/1957 | Gauthier | 242/596.7 X |
| 3,001,736 | 9/1961 | Schultz et al. | 242/72 |
| 3,523,653 | 8/1970 | Hansen | 242/55.53 |
| 3,923,223 | 12/1975 | Larsson et al. | 225/46 |
| 4,579,266 | 4/1986 | Bunger et al. | 225/19 |
| 4,796,832 | 1/1989 | Schutz et al. | 242/55.3 |
| 4,872,601 | 10/1989 | Sigmund | 242/55.3 X |
| 4,878,631 | 11/1989 | Tanovici | 242/597.5 X |
| 5,058,792 | 10/1991 | Morand | 225/42 |
| 5,172,840 | 12/1992 | Bloch et al. | 225/37 |

FOREIGN PATENT DOCUMENTS 2063213 6/1981 United Kingdom .

*Primary Examiner*—John Q. Nguyen
*Attorney, Agent, or Firm*—Harold L. Novick; Nath & Associates

[57] ABSTRACT

A bathroom tissue dispenser for holding both a large fresh roll and a remnant roll of bathroom tissues. The dispenser has a base with a spindle on a main support area of the base for carrying the large fresh roll of bathroom tissue. The base has a secondary support area beneath the main support area with stub shafts thereon for carrying the remnant roll of bathroom tissue directly beneath the large roll. The remnant roll is carried with its axis perpendicular to the axis of the large roll. The spindle preferably has a tubular body and detachable ribs for increasing the diameter of the body.

16 Claims, 5 Drawing Sheets

LARGE ROLL BATHROOM TISSUE DISPENSER WITH STUB ROLL HOLDER

This application is a continuation of application Ser. No. 08/148,855 filed Nov. 8, 1993, abandoned.

FIELD OF THE INVENTION

This invention is directed toward an improved bathroom tissue dispenser. The invention is also directed toward an improved spindle for holding bathroom tissue rolls.

The invention is more particularly directed toward an improved tissue dispenser of the type that holds both a new roll of tissue and a remnant roll. The invention is also more particularly directed toward an improved spindle that can have its size changed to hold different sizes of cores.

It is common now to employ large rolls of bathroom tissue because the large rolls reduce the number of times that the rolls must be replaced. By a large roll it is meant a roll at least nine inches in diameter but the roll can be twelve or more inches in diameter. However when the dispensers employing the large rolls are serviced it is common for the remnant roll to be thrown out before it is fully used up to avoid running out of tissue before the next servicing. Disposal of the remnant roll is wasteful. It is known to provide a dispenser that can hold both a a new roll and a remnant roll at the same time so that the remnant roll can be used up before it is disposed of. This eliminates the waste of tissue. Examples of such dispensers are shown in U.S. Pat. Nos. 4,796,832 and 5,172,840. However these dispensers are quite large with complicated mechanisms, making them expensive to manufacture and maintain and awkward to use. In addition, in the known dispensers, the user is not led to use up the remnant roll before starting on the new roll so that the problem of waste can remain. It is the purpose of the present invention to provide an improved dispenser that holds both a fresh roll and a remnant roll of bathroom tissue with the dispenser being relatively compact compared to known dispensers of this type. The dispenser of the present invention is only slightly larger than a dispenser that employs only a large roll. In addition, the dispenser of the present invention is constructed to locate the remnant roll in a position where the user is led to use it up before use of the fresh large roll is started.

The improved dispenser employs mounting means for the remnant roll just below the large roll, the mounting means located between the large roll and the outlet for the dispenser. Thus the user is led to use up the remnant roll before starting to use the fresh roll.

The known dispensers are built with a spindle for the roll that fits a standard size of roll or more particularly a standard size of core used in the roll. The dispenser cannot be used with other core sizes. It is the purpose of the present invention to provide a roll spindle that can be used with several different core sizes.

SUMMARY OF THE INVENTION

In accordance with the present invention, the roll spindle is provided with detachable means that can vary the circumference of the spindle so that it can be used with different sized cores. The detachable means comprise a set of ribs that can be mounted on the spindle. Preferably the ribs can be mounted in one of two ways to accommodate a different sized core in each way. The invention is particularly directed toward a bathroom tissue dispenser having a base, the base having a main support area and a secondary support area extending down from the main support area. A large roll spindle is mounted in the central portion of the main support area, the axis of the spindle extending transversely to the main support area. Secondary support means are provided on the secondary support area for carrying a remnant roll, the axis of the secondary support means extending transversely to the axis of the spindle.

The invention is also directed toward a spindle having a tubular body and detachable means for increasing the diameter of the body. The body and diameter increasing means have cooperating means for detachably connecting them together.

DESCRIPTION OF THE PREFERRED EMBODIMENTS

Figure 1:
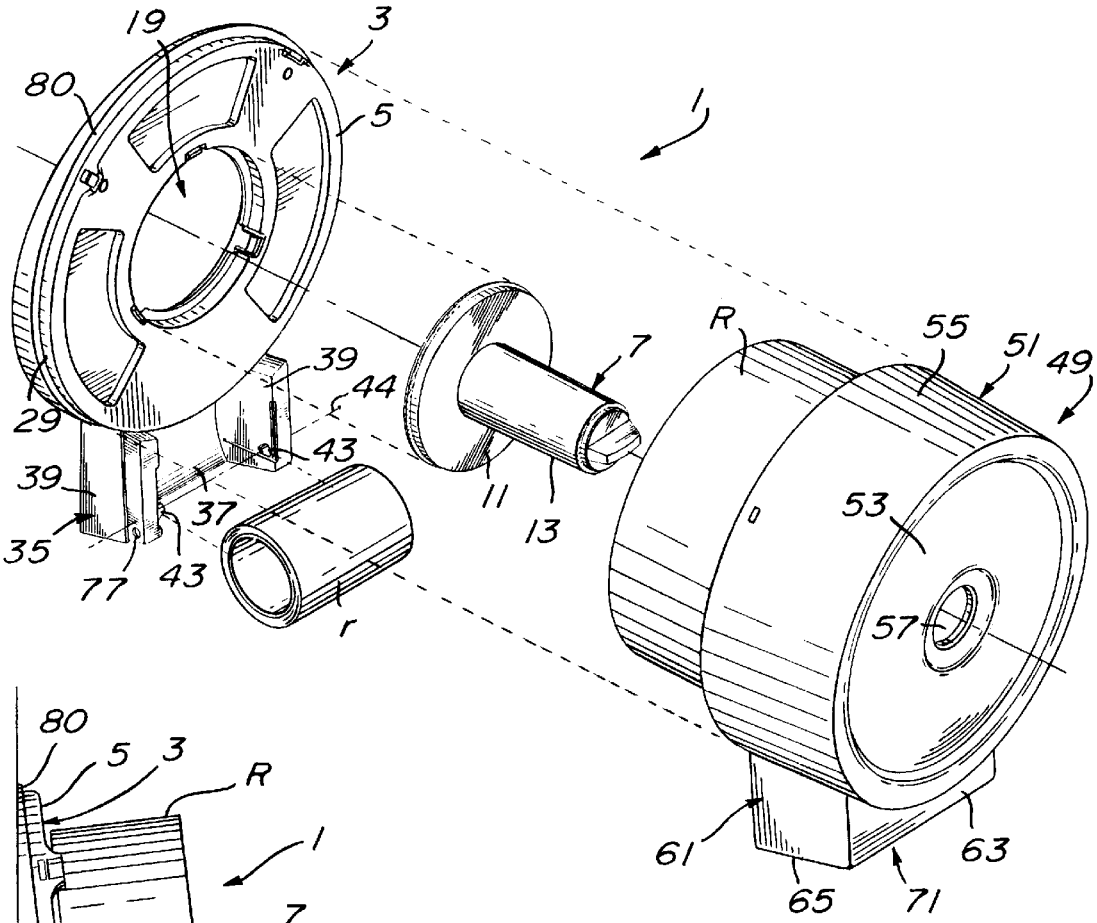
FIG. 1 is an exploded view of the dispenser and the bathroom tissue rolls used with it.
Figure 2:
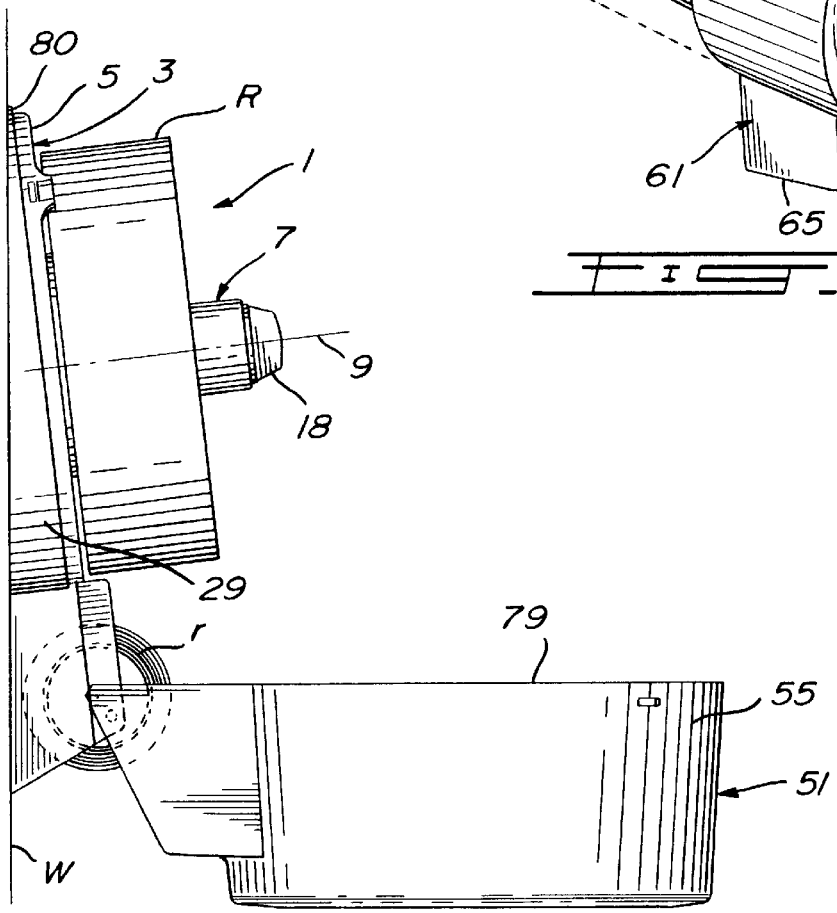
FIG. 2 is a side view of the dispenser mounted on a wall with the cover open.
Figure 3:
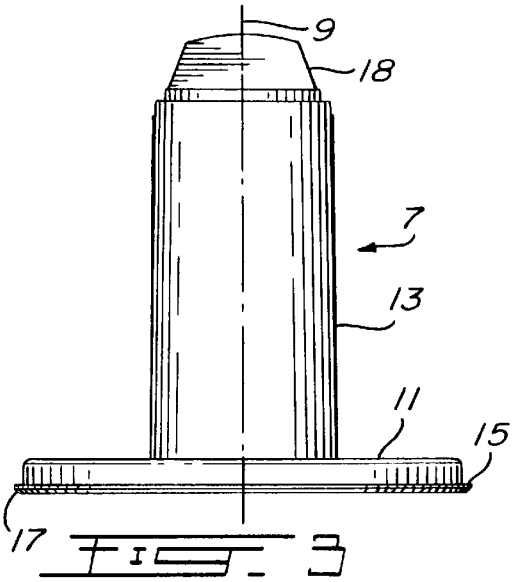
FIG. 3 is an elevation view of the spindle.

The bathroom tissue dispenser 1 of the present invention, as shown in FIGS. 1 and 2, has a base 3. The base 3 has a main support area 5 for supporting a large roll "RI" of bathroom tissue. The support area 5 is plate-like, circular in shape, and carries a spindle 7 in it's central portion. The axis 9 of the spindle 7 extends transversely from the support area 5. The spindle 7, as shown in FIG. 3, has a thin cylindrical base 11 with a tubular body 13 extending up from the center of the base 11. A narrow flange 15 extends outwardly from the bottom portion of the base 11. The lower, outer corner of the flange 15 is cut away to form a camming edge 17. The free end 18 of the spindle body 13 can be shaped to provide a turning knob.

Figure 4:
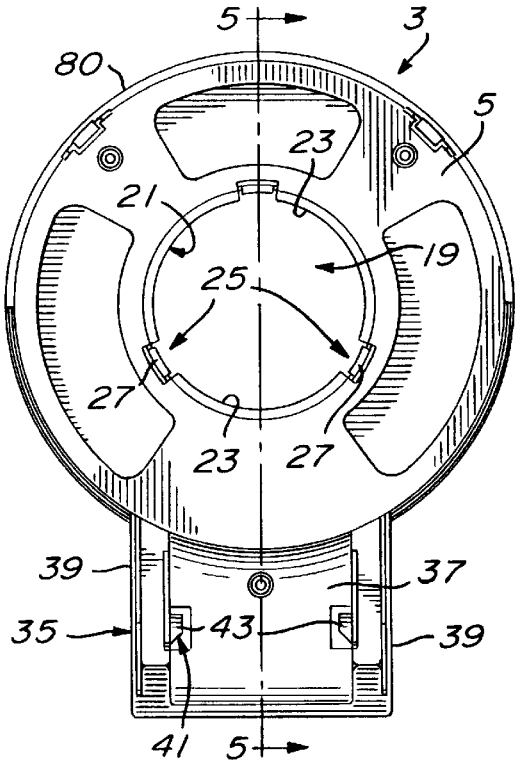
FIG. 4 is a front view of the base.
Figure 5:
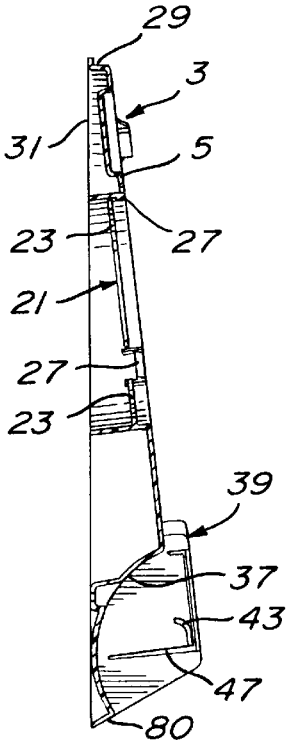
FIG. 5 is a cross section view of the base taken along line 5—5 of FIG. 4.
Figure 6:
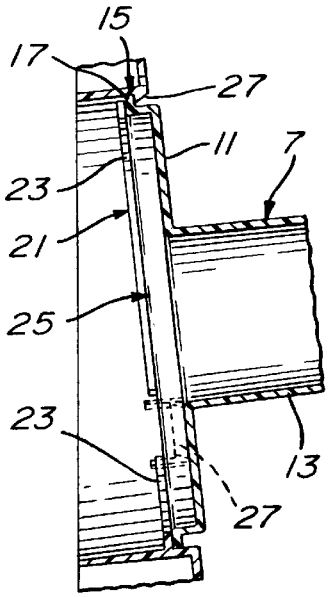
FIG. 6 is a detail view showing the spindle mounted on the base.

Preferably the spindle 7 is detachably, rotatably connected to the support area 5. To this end a circular opening is provided in the center of the support area 5 of the base as shown in FIGS. 4 and 5. The opening 19 is stepped to provide a narrow support rim 21 on which the base 11 rests when the spindle 7 is mounted on the support area 5. The rim 21 is broken into segments 23. Overlying the open sections 25 between the rim segments 23 are short, flexible tabs 27. The tabs 27 are spaced above the rim 21 a distance just slightly greater than the thickness of the flange 15 of the spindle. The spindle 7 is detachably mounted on the support area 5 of the base 3 by pressing it down against the tabs 27 until the edge of the flange 15 snaps past the tabs 27 to rest on the rim 21 as shown in FIG. 6. The tabs 27 hold the flange 15 on the rim 21 thus rotatably mounting the spindle 7 on the base 3. Other types of connection means can be employed to rotatably connect the spindle 7 to the base 3.

The base 3 has a sidewall 29 that encircles the perimeter of the circular support area 5 as shown in FIGS. 1 and 5. The bottom edge 31 of the sidewall 29 lies in a plane that is at a slight angle to the plane containing the support area 5. The sidewall 29 rests against a support wall W when the dispenser is mounted on the support wall W thus angling the bottom of base 3 outwardly from the support wall W as shown in FIG. 2. Suitable means, not shown, can be provided on the base to permit the use of fasteners to fasten the base to the support wall W.

Figure 7:
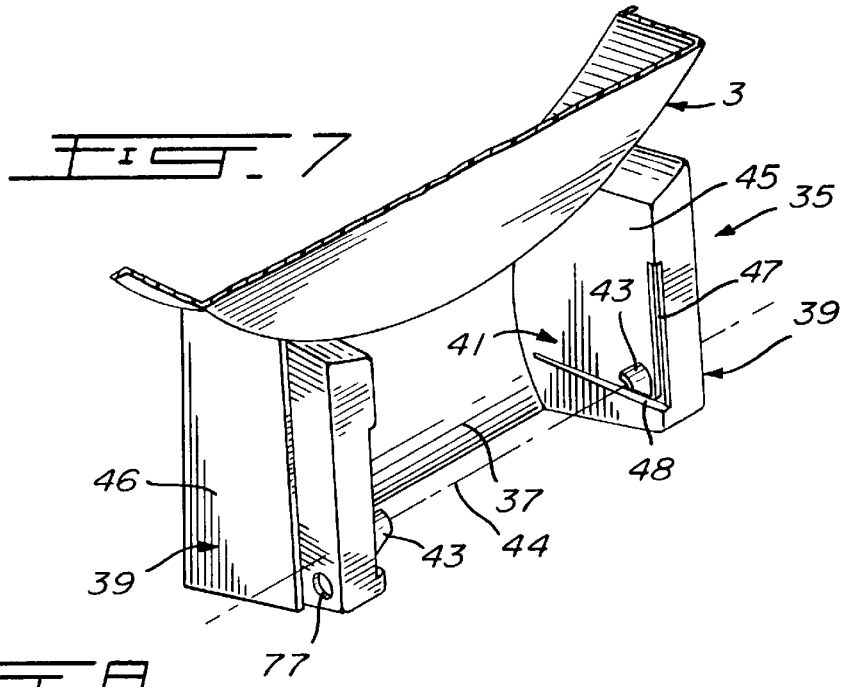
FIG. 7 is a detail perspective view of the secondary support area.

The base 3 includes a secondary support area 35 that extends downwardly from the main support area 5 as shown in FIG. 7. The secondary support area 35 has a back wall 37 and two side walls 39. The back wall 37 curves rearwardly and downwardly from the bottom peripheral edge of the support area 5 presenting a concave front face. The side walls 39 extend slightly forwardly of the support area 5 and together with the back wall 37 form a recess to partly receive a paper roll remnant "r". Having the bottom of the base 3 angled slightly outwardly provides room for the remnant roll "r" at the bottom of the base.

The secondary support area 35 has secondary support means 41 for carrying the paper roll remnant "r". The secondary support means 41 can comprise a short stub shaft 43 on the inner face of each side wall 39. The stub shafts 43 extend toward each other and are located near the outer lower corners of the side walls 39. The axis 44 joining the stub shafts 43 is perpendicular to the axis 9 of the spindle 7 as shown in FIG. 1. The roll remnant "r" is mounted between the stub shafts 43 by moving them apart. To permit the stub shafts to move apart, the side walls 39 are made hollow with an inner wall 45 and an outer wall 46. The inner wall 45 has an angled slot 47 in it. The stub shaft 43 is located adjacent the inner corner 48 of the slot 47. The slot 47 allows the section of the inner wall 45 carrying the stub shaft 43 to be flexed inwardly. The resiliency of the inner walls 45 permits this.

Figure 8:
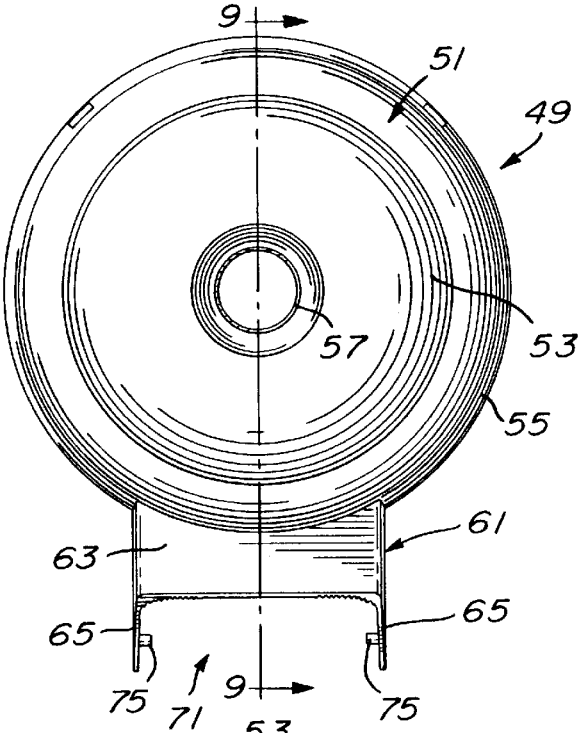
FIG. 8 is a front view of the cover.
Figure 10:
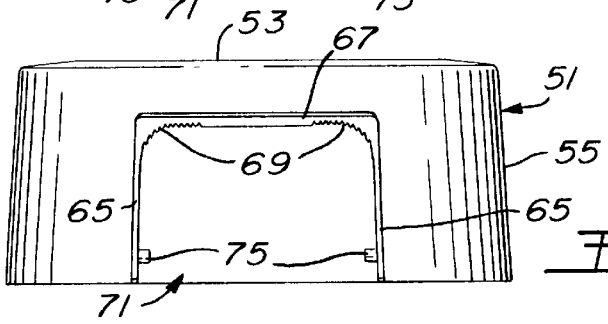
FIG. 10 is a bottom view of the cover.

A cover 49 is provided for covering the large roll "R" and the remnant roll "r" carried on the base. The cover 49, as shown in FIGS. 8 and 10 has a generally circular, dished-shaped main cover portion 51 having a circular front wall 53 and a side wall 55. The side wall 55 tapers outwardly slightly from the periphery of the front wall 53. There is a circular opening 57 in the center of the front wall 53 through which the spindle 7 projects as will be described. The cover 49 also has a secondary cover portion 61 that extends down from the main cover portion 51. The secondary cover portion 61 has a front wall 63 and side walls 65. There is also a short bottom wall 67 that extends rearwardly from the bottom of the front wall 63. The free edge of the bottom wall 67 is rounded at both ends to form rounded inner corners as shown at 69 in FIG. 10 where it merges into the side walls 65. The rounded inner corners 69 are serrated to help tear tissue being dispensed.

Figure 9:
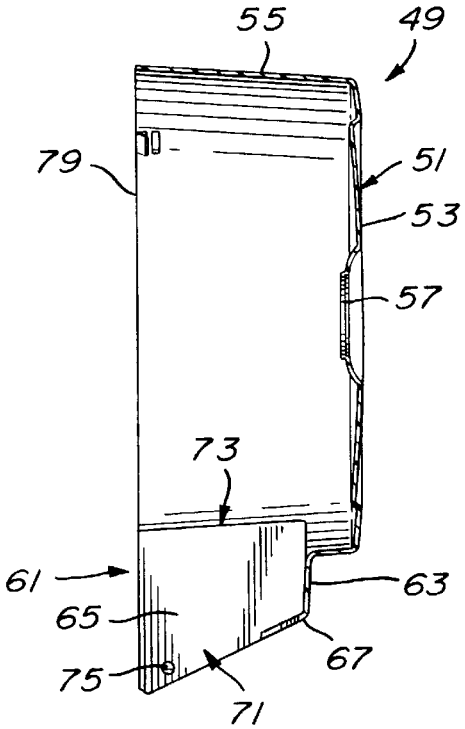
FIG. 9 is a cross section view of the cover taken along line 9—9 of FIG. 8.

The bottom of the secondary cover portion 61 is open as shown at 71 except for the short bottom wall 67 extending rearwardly from the front wall 63. The opening 71 forms the outlet opening for dispensing tissue from either a large roll or a remnant roll. There is also an opening 73 in the side wall 55 of the main cover portion as shown in FIG. 9. The opening 73 is generally bounded by the front and side walls 63, 65 of the secondary cover portion 61 and connects the interior of the main cover portion 51 with the interior of the secondary cover portion 61. The openings 71 and 73 are aligned and large enough for a person to stick his hand within the cover 49 to grasp a free end of tissue if the free end ends up within the cover for some reason.

Hinge pins 75 are provided on the lower bottom corners of the side walls 65 of the secondary cover portion 61. The hinge pins 75 extend toward each other and are sized to fit in openings 77 provided in the the outer walls 46 of the side walls 39 of the base. The cover 49 is mounted on the base by having the hinge pins 75 placed in the openings 77. The side walls 65 of the cover are flexible enough to be moved outwardly to allow the pins 75 to be placed in the openings 77. Means, not shown, can be provided to lock the cover 49 in a closed position overlying the base 3. In the closed position, the free edge 79 of the side wall 55 rests against a rim 80 on the outer peripheral portion of the sidewall 29.

In use, the cover 49 is opened by pivoting it about the hinge pins 75 to allow placement of a large roll "R" on the spindle 7. Preferably the core of the roll fits snugly on the spindle so that it will rotate with the spindle. The roll rests against the spindle base 11'. The cover 49 is closed with the free end 18 of the spindle 7 extending through the opening 57 in the front wall 53 of the cover. The free end of the tissue on the large roll "R" extends down toward the bottom dispensing opening 71 through the connecting opening 73. The free end can be grabbed by reaching up within the cover through the dispensing opening 71 and pulling it down. A length can be torn off by pulling it against one of the serrated corners 69 on the cover 49. The free end 18 of the spindle that extends through the opening 57 in the cover 49 can be rotated to rotate the roll "R" to make its free end more accessible through the dispensing opening 71.

When the large roll "R" on the spindle is nearly used up, it is replaced with a fresh, large roll. Instead of disposing of the remnant roll "r" as in the past, the remnant roll "r" is now mounted on the secondary support means 41 below the fresh large roll. To assist the maintenance people in making this decision the spindle base 11' is sized so that when the roll "R" is reduced in diameter to less than the diameter of the spindle base 11' the roll is then moved to the secondary support means 41. To make this observation easier the spindle base 11' can be a distinctive colour.

When the remnant roll "r" is mounted on the stub shafts 43 it makes access to the large, fresh roll through the connecting opening 73 difficult. The remnant roll "r" however is accessible through the dispensing opening 71. Once the remnant roll "r" is used up there is easy access to the fresh, large roll through both openings 71 and 73.

Figure 11:
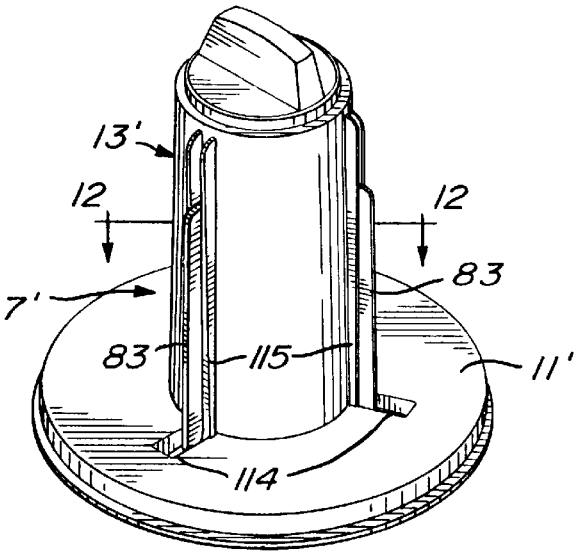
FIG. 11 is a perspective view of another embodiment of the spindle with detachable ribs in place.
Figure 12:
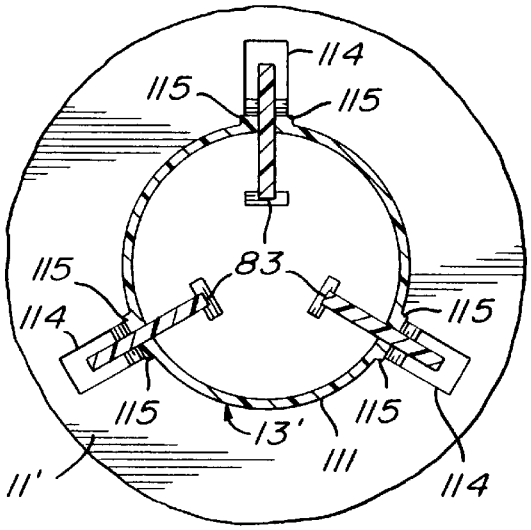
FIG. 12 is a detail cross section view taken along line 12—12 of FIG. 11.
Figure 13:
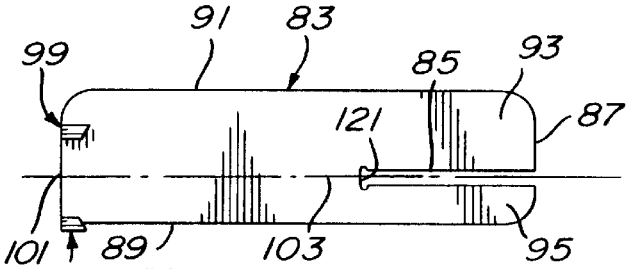
FIG. 13 is a plan view of a rib used in the spindle of FIG. 11.
Figure 14:
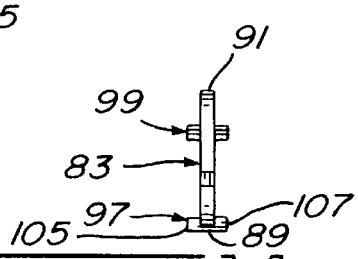
FIG. 14 is an end view of the rib.

The spindle 7 receives a standard size of roll. However it is preferred that the spindle be constructed to receive rolls having different sized cores. To this end a spindle 7' is provided with means for varying its circumference. The circumference varying means are detachably mounted on the spindle 7' and preferably comprise ribs 83 that extend longitudinally along the spindle when detachably mounted thereon as shown in FIGS. 11 and 12. Preferably at least three ribs 83 are used, equally spaced apart about the circumference of the spindle 7'. In more detail, each rib 83 comprises a slat-like member as shown in FIGS. 13 and 14.

A substantially U-shaped slot 85 is provided in the rib member 83 extending inwardly from one end 87 of the member to a midportion thereof. The slot 85 extends inwardly parallel to the sides 89, 91 of the member and has a length slightly less than one half the length of the member. The slot 85 is positioned to be closer to one side 89 of the member 83 than the other side 91. This divides the slotted portion of the rib into a wide portion 93 and a narrow portion 95. The slot 85 has a width equal to the thickness of the wall of the spindle 7'. The rib has two sets of stops 97, 99 at its other end 101. One set of stops 97 is positioned adjacent the side 89 of the rib. The other set of stops 99 is positioned as far away from the center line 103 of the slot 85 toward the side 91 of the rib as the stops 97 are positioned from it. Each set of stops 97, 99 can comprise small tabs 105, 107 on both surfaces of the rib.

Figure 15:
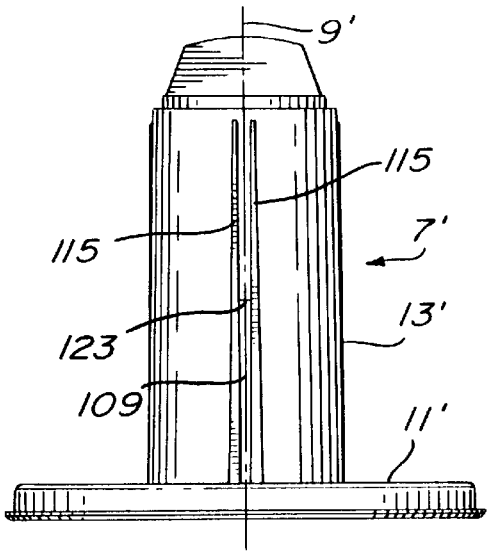
FIG. 15 is an elevation view of the spindle without the ribs.
Figure 16:
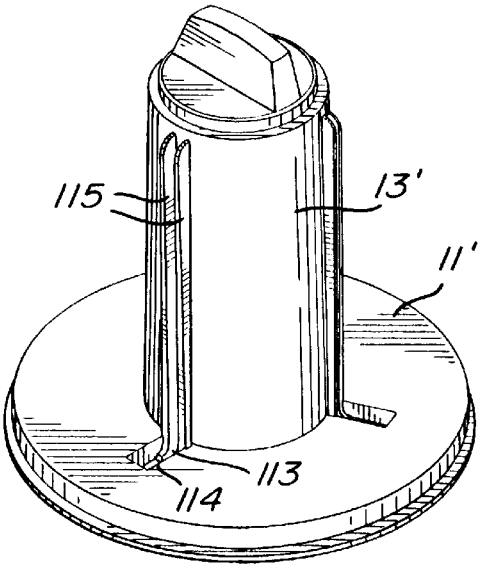
FIG. 16 is a perspective view of the spindle without ribs.
Figure 17:
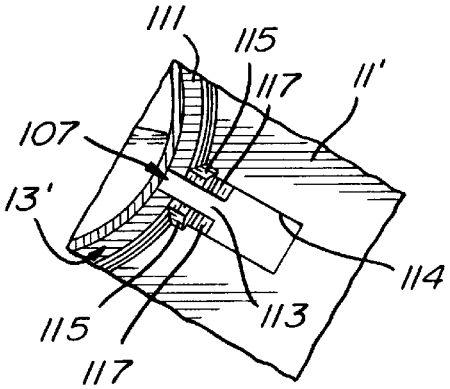
FIG. 17 is a detail top view of the spindle showing the bottom of the slot.
Figure 18:
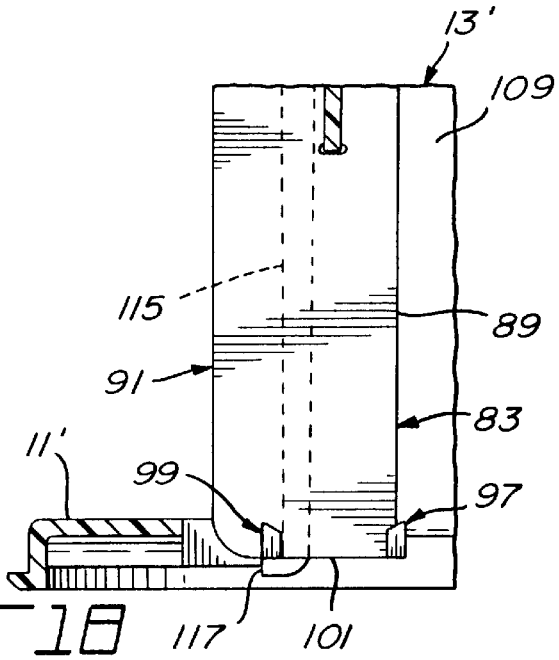
FIG. 18 is a detail view of the locking means for the rib.

The spindle 7' is constructed with three equally spaced apart substantially U-shaped slots 109 in the tubular wall 111 of its tubular body 13' as shown in FIGS. 15 to 17. Each slot extends up from the base 11' of the spindle 7', parallel to the axis 9' of the spindle to a midportion thereof. Each slot 109 is about half the length of the spindle and continues radially, as shown by 113 in FIG. 17, into the base 11' where it forms an enlarged opening 114. The spindle 7' is provided with a side wall 115 on each side of each slot 109. The side walls 115 are relatively low and extend for nearly the entire length of the spindle. The side walls 115 taper inwardly slightly in moving outwardly from the base. The side walls 115 are used to support the smallest size of core and also to provide lateral support for the ribs 83 as will be described. There is a small radial extending projection 117 at the bottom of each side wall 115 as shown in FIG. 18. The projections 117 serve to lock the ribs 83 in place as will be described.

In use, the spindle 7' can be used to frictionally hold a roll with one standard size of core by placing the core directly on the spindle over the side walls 115. The tapered side walls 115 frictionally hold the core on the spindle. If a larger core is to be used, the ribs 83 can be mounted in the slots 109 to increase the circumference of the spindle 7'. Each rib 83 is slid up from the bottom of the spindle through the radial section 113 of the slot 109 and between the side walls 115 to have its slot 85 receive the top portion of the wall 111 of the spindle as shown in FIG. 17. The rib 83 is moved up until the bottom 121 of its slot 85 abuts the top 123 of the slot 109 in the spindle. At this point one of the set of stops 97, 99 on the rib 83 slip over the projections 117 at the bottom of the side walls 115 as shown in FIG. 18 and the rib 83 is locked in place between the projections 117 and the end of the slot 123 in the spindle. The ribs 83 can be mounted with the narrow portion 95 of the rib outwardly to receive a larger size of core with stops 97 abutting projections 117 (not shown) or with the wider portion 93 outwardly to receive a still larger size of core with stops 99 abutting projections 117 as shown in FIG. 18. The ribs 83 can be easily removed by slipping them off the projections 117 and pulling them off the spindle.

The use of the ribs 83 permit the spindle 7' to be used with three different sizes of cores. The ribs 83 can be stored when not needed.

I claim:

1. A bathroom tissue dispenser for holding a large roll of bathroom tissue and a remnant roll of tissue that is substantially smaller than the large roll, said dispenser having:

a base, the base having a main support area with a central portion and a secondary support area positioned directly below the main support area;

a large roll spindle, the spindle mounted in the central portion of the main support area for carrying a large roll of bathroom tissue, the longitudinal axis of the spindle extending transversely to the main support area;

a cover engaging said base, the cover having a main cover portion with a bottom and sized to cover a large roll when mounted on the spindle;

secondary support means on the secondary support area, the secondary support means, located directly under the spindle, and including means for providing an axis of support which extends transverse to the axis of the spindle, support means rotatably supporting the remnant roll of bathroom tissue on an axis of rotation of the remnant roll that is parallel to the axis of support; and means for permitting access into the interior of said cover only through the bottom thereof when said cover engages said base, and thus for permitting access to a large roll when mounted on said spindle, said means including an opening in the main cover portion, the opening being above a remnant roll carried on the secondary support means and of such a size that the opening is substantially blocked when a remnant roll is supported by said secondary support means so as to block the use of a large roll until the remnant roll is used up.

2. A bathroom tissue dispenser as claimed in claim 1 wherein said cover includes a main cover portion sized to cover a large roll mounted on the spindle; and a secondary cover portion positioned below the main cover portion and sized to cover a remnant roll mounted on the secondary support means, there being an interior opening between the main cover portion and the secondary cover portion.

3. A bathroom tissue dispenser as claimed in claim 1, and including a secondary cover portion having a bottom outlet opening for dispensing the bathroom tissue, the bottom opening being aligned with a remnant roll when mounted on said stub shafts, said opening allowing access to the remnant roll when the remnant roll is in place and the bottom opening and main cover opening being aligned and thereby allowing access to the large roll when the remnant roll is used up.

4. A bathroom tissue dispenser having:

a base, the base having a main support area with a central portion and a secondary support area positioned directly below the main support area;

a large roll spindle, the spindle mounted in the central portion of the main support area for carrying a large roll of bathroom tissue, the longitudinal axis of the spindle extending transversely to the main support area;

secondary support means on the secondary support area for supporting a remnant roll, the secondary support means, located under the spindle, having an axis of support which extends transverse to the axis of the spindle; the axis of support supporting a remnant roll of bathroom tissue, which roll is substantially smaller than the large roll, with the axis of rotation of the remnant roll parallel to the axis of support;

a cover, the cover having a main cover portion sized to at least substantially completely cover a large roll mounted on the spindle and a secondary cover portion positioned below the main cover portion and sized to cover a remnant roll mounted on the secondary support means, said secondary cover portion being substantially smaller than said main cover portion, an interior opening in the main cover portion and positioned between the main cover portion and the secondary cover portion, the interior opening being directly above a remnant roll carried on the secondary support means and of such a size that the interior opening is substantially blocked by the remnant roll so as to prevent the use of the large roll until the remnant roll is used up, and a bottom outlet opening in the secondary cover portion for dispensing the bathroom tissue and positioned below the remnant roll, the bottom opening vertically aligned with the interior opening, the bottom opening allowing access to the remnant roll when it is in place and the bottom opening and interior opening together allowing access to the large roll when the remnant roll is used up.

5. A bathroom tissue dispenser as claimed in claim 4 wherein the cover is pivotally mounted onto the secondary support means of the base.

6. A bathroom tissue dispenser as claimed in claim 4 wherein the secondary support means comprise a pair of oppositely facing stub shafts on which the ends of a remnant roll are mounted.

7. A bathroom tissue dispenser as claimed in claim 6 wherein the spindle has a tubular body having a bottom and detachable means for increasing the radial size of the body, the body and the radial size increasing means having cooperating means for detachably connecting them together.

8. A bathroom tissue dispenser as claimed in claim 7 wherein the tubular body has longitudinally extending, circumferentially spaced apart slots, the radial size increasing means comprising ribs insertable into the slots.

9. A bathroom tissue dispenser as claimed in claim 8 wherein the slots extend up from the bottom of the tubular body in the wall of the tubular body, each rib having a longitudinally extending slot receiving the wall of the tubular body longitudinally adjacent the slots in the tubular body.

10. A bathroom tissue dispenser as claimed in claim 9 wherein the slot in each rib divides the rib into a wide portion and a narrow portion and wherein the rib can be mounted on the body in a first position with the wide portion of the rib positioned radially outwardly from the body or in a second position with the narrow portion of the rib positioned radially outwardly from the body.

11. A bathroom tissue dispenser as claimed in claim 10 including cooperating means on the ribs and body for locking the ribs in the slots in the tubular body in either position.

12. A bathroom tissue dispenser as claimed in claim 6 wherein the stub shafts are resiliently mounted so that they can be moved away from each other to mount the remnant roll thereon.

13. A spindle for a bathroom tissue dispenser having:

a tubular body having a bottom, a top and a midportion between said bottom and said top, said tubular body being comprised of a wall;

ribs for increasing the radial size of the body;

the body and the ribs having cooperating means for detachably connecting them together;

the tubular body having longitudinally extending substantially U-shaped slots having sides and terminated by an end wall, said slots being circumferentially spaced apart and extending up from the bottom of the tubular body in the wall of the tubular body to the midportion of the tubular body, each rib having a bottom and a midportion and a longitudinally extending substantially U-shaped slot extending up from the bottom of the rib to the midportion of the rib and terminated by an end wall, said rib slot being insertable into the slot in the tubular body with the slot in the rib receiving the wall of the body adjacent the tubular body slot and the end wall of the rib slot being adjacent the end wall of the tubular body slot when so inserted.

14. A spindle as claimed in claim 13 wherein said tubular body further includes outwardly, radially projecting side walls longitudinally extending along the sides of at least one of said tubular body slots.

15. A spindle as claimed in claim 13 wherein the slot in each rib divides the rib into a wide portion and a narrow portion and wherein the rib can be mounted on the body in a first position with the wide portion of the rib positioned radially outwardly from the body or in a second position with the narrow portion of rib positioned radially outwardly from the body.

16. A spindle as claimed in claim 15 including cooperating means on the ribs and body for locking the ribs in the slots in the tubular body in either position.

* * * * *

UNITED STATES PATENT AND TRADEMARK OFFICE

CERTIFICATE OF CORRECTION

PATENT NO. : 5,833,169
DATED : November 10, 1998
INVENTOR(S) : Michel Morand

It is certified that error appears in the above-identified patent and that said Letters Patent is hereby corrected as shown below:

Cover Page, Assignee: delete "G.H. Wood & Wyant Inc."

Cover Page, Assignee: add --Wood Wyant Inc.--.

Signed and Sealed this

Eighth Day of August, 2000

*Attest:*

*Attesting Officer*

Q. TODD DICKINSON

*Director of Patents and Trademarks*